US008096544B2

(12) United States Patent
Kano

(10) Patent No.: US 8,096,544 B2
(45) Date of Patent: Jan. 17, 2012

(54) SHEET CONTAINING DEVICE AND IMAGE FORMING DEVICE AND METHOD OF OPERATING SHEET CONTAINING DEVICE

(75) Inventor: Hiromi Kano, Tokyo (JP)

(73) Assignee: Oki Data Corporation, Tokyo (JP)

( * ) Notice: Subject to any disclaimer, the term of this patent is extended or adjusted under 35 U.S.C. 154(b) by 17 days.

(21) Appl. No.: 12/570,277

(22) Filed: Sep. 30, 2009

(65) Prior Publication Data

US 2010/0084807 A1 Apr. 8, 2010

(30) Foreign Application Priority Data

Oct. 8, 2008 (JP) ..... 2008-262150

(51) Int. Cl.
*B65H 3/44* (2006.01)

(52) U.S. Cl. ..... 271/9.02; 271/9.05; 271/9.07; 271/9.11

(58) Field of Classification Search ..... 271/9.02, 271/9.05–9.08, 9.11, 9.12
See application file for complete search history.

(56) References Cited

U.S. PATENT DOCUMENTS 7,290,762 B2 * 11/2007 Connors et al. ..... 271/9.07
2008/0080917 A1 * 4/2008 Yoshimoto et al. ..... 400/55

FOREIGN PATENT DOCUMENTS

JP 2004-91211 A 3/2004

* cited by examiner

*Primary Examiner* — Michael McCullough
(74) *Attorney, Agent, or Firm* — Posz Law Group, PLC

(57) ABSTRACT

A sheet containing device includes a supporting part that supports a first sheet and a second sheet, wherein the first sheet and the second sheet are different types of media, and the first sheet and the second sheet are stacked on one another; a feeding member that is located at a front end of the supporting part and that feeds the first sheet and the second sheet in correspondence with rotation of the feeding member; a sheet operating member that selectively prevents one of the first sheet and the second sheet from being fed by the feeding member.

17 Claims, 17 Drawing Sheets

SHEET CONTAINING DEVICE AND IMAGE FORMING DEVICE AND METHOD OF OPERATING SHEET CONTAINING DEVICE

CROSS REFERENCE TO RELATED APPLICATION

The invention is related to, claims priority from, and incorporates by reference Japanese Patent Application No. 2008-262150, filed on Oct. 8, 2008.

TECHNICAL FIELD

The present invention relates to a sheet containing device, an image forming device including the sheet containing device, and a method of operating the sheet containing device.

BACKGROUND

Conventionally, there have been image forming devices such as a printer, a photocopier, a facsimile machine, and a multifunction machine. For example, in a case of a printer, a charge roller charges a surface of a photoreceptor drum, an LED head exposes the surface of the photoreceptor drum to form an electrostatic latent image, thin-layered toner on a developing roller electrostatically adheres to the electrostatic latent image, and a toner image is formed. Then, a transferring roller transferees the toner image to a sheet, or medium, a fuser fuses the toner image, and an image is formed. A cleaning blade removes residual toner from the photoreceptor drum after the transfer, and the toner is collected.

In order to form an image on a relatively long sheet, the length of which is greater than that of standardized sheets for a printer, a sheet tray is provided in a printer.

FIG. 2 is a schematic view of a printer equipped with a conventional sheet tray.

In FIG. 2, 101 illustrates a main body of a printer functioning as a main body of a device, and 70 illustrates a sheet tray comprising a sheet receiving part 71, a sheet read-end guide part 72, a tray upper guide 74, and a sheet rear-portion holding guide 75. The sheet receiving part 71 is attached to a sheet feeding part that is not shown. The sheet rear-end guide part 72 is upwardly extended and is located so that a rear portion of a relatively long sheet P placed in the sheet receiving part 71 may be folded. The sheet rear-end guide part 72 prevents the relatively long sheet P from slipping off the sheet tray 70 because of a reaction that a rear portion of the relatively long sheet P shifts from a folded position to straightened position when the relatively long sheet P is fed. The tray upper guide 74 and the sheet rear-portion holding guide 75 hold the relatively long sheet P such that the rear portion of the relatively long sheet P is rolled. See Japanese laid-open patent application publication No. 2004-91211.

However, the above-mentioned conventional sheet tray 70 may not simultaneously place plural of sheets having different sizes. In order to feed other-sized sheets except a relatively long sheet P, the other-sized sheets need to be placed in a sheet feeding part of the main body of a device after detaching the sheet tray 70 from the main body of the device 101, and need to be placed in the sheet tray 70 after once removing the relatively long sheet P from the sheet tray 70.

Accordingly, an operability of the sheet tray 70 is decreased, because not only attaching/detaching of such as sheets are troublesome but also some spaces are needed to keep the detached sheet tray 70 or the removed relatively long sheets P.

An object of the present invention is to solve problems of the conventional sheet tray 70 and to provide a sheet containing device and an image forming device that are easier to operate and require less space.

SUMMARY

In the present invention, a sheet containing device includes a supporting part that supports a first sheet and a second sheet, wherein the first sheet and the second sheet are different types of media, and the first sheet and the second sheet are stacked on one another; a feeding member that is located at a front end of the supporting part and that feeds the first sheet and the second sheet in correspondence with rotation of the feeding member; a sheet operating member that selectively prevents one of the first sheet and the second sheet from being fed by the feeding member.

With the configuration, the first and second mediums are selectivity sent to the feeding member and are fed by the feeding member, so that, not only are operations to attach/detach the medium tray and to remove and replace sheets unnecessary but also storage spaces to keep a detached medium tray and removed sheets are unnecessary. Therefore, the operation of the device is more efficient and the device requires less space.

BRIEF DESCRIPTION OF DRAWINGS

FIGS. 5A and 5B are enlarged views of a region AR1 shown in FIG. 4.

FIG. 9 is an enlarged view of a region AR2 shown in FIG. 8.

FIG. 13 is an enlarged view of a region AR3 shown in FIG. 12.

FIG. 15 is an enlarged view of a region AR4 shown in FIG. 14.

DETAILED DESCRIPTION

Figure 1:
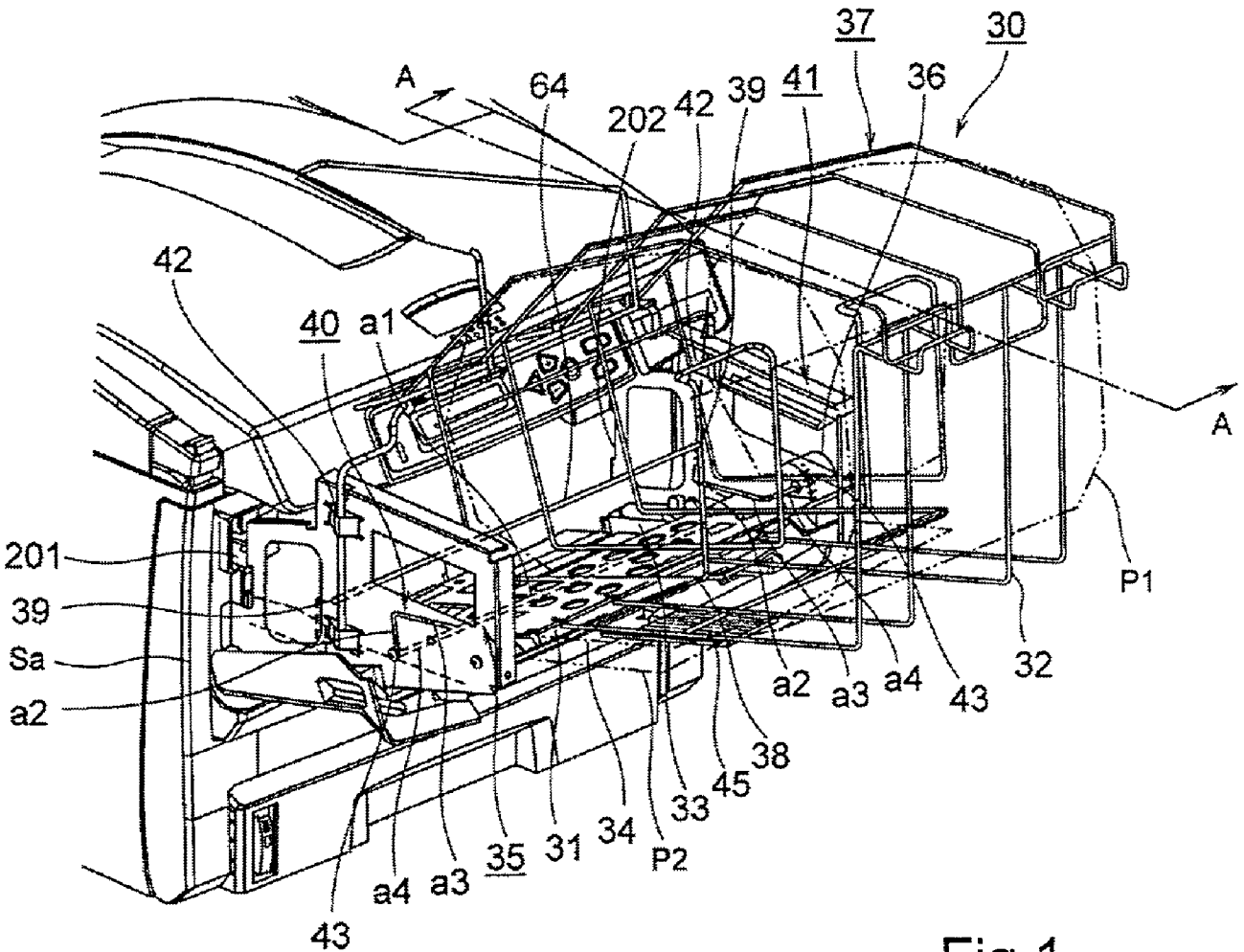
FIG. 1 is a perspective view of a sheet containing device according to a first embodiment of the present invention.
Figure 2:
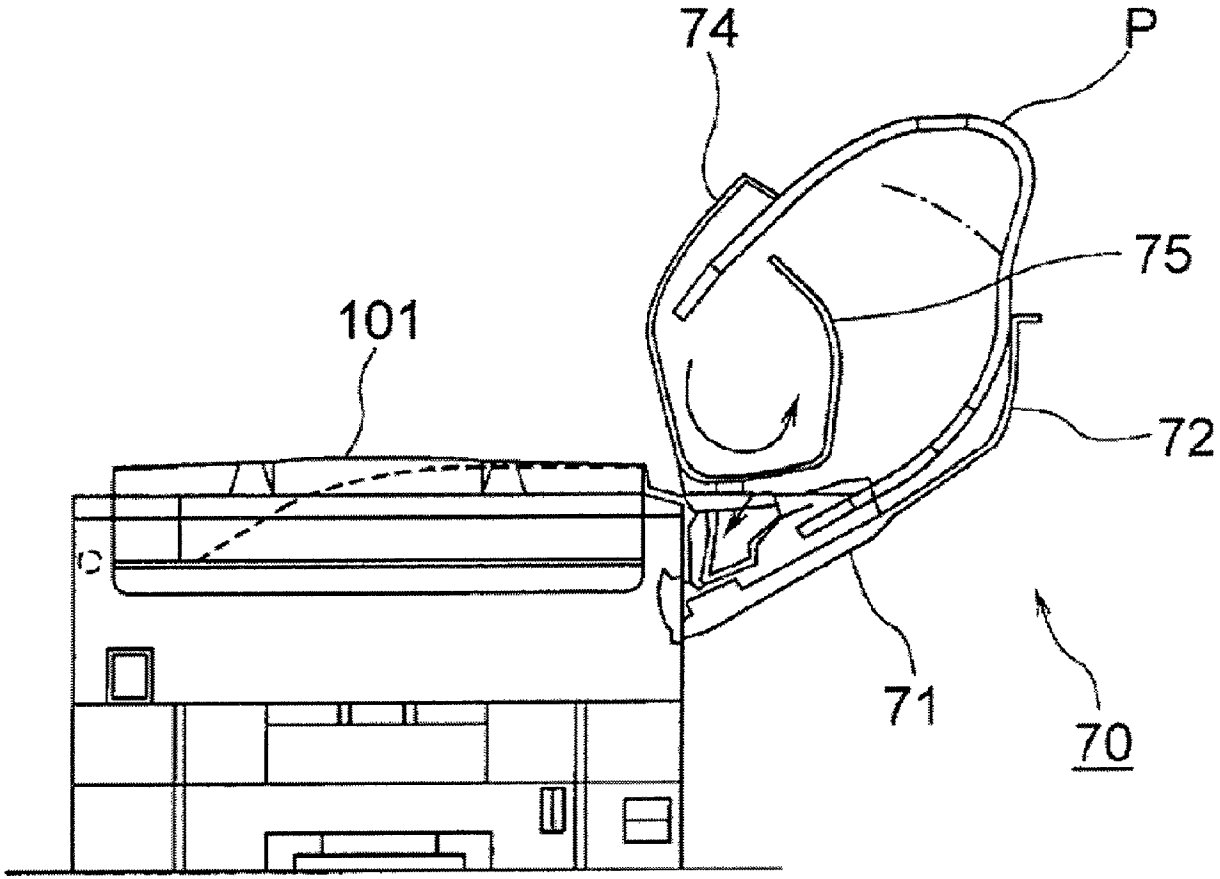
PRIOR ART Fig.2
FIG. 2 is a schematic view of a printer provided with the conventional sheet tray.

Hereafter, embodiments of the present invention will be described in detail with referring to the drawings, and a printer as an image forming device will be described.

Figure 3:
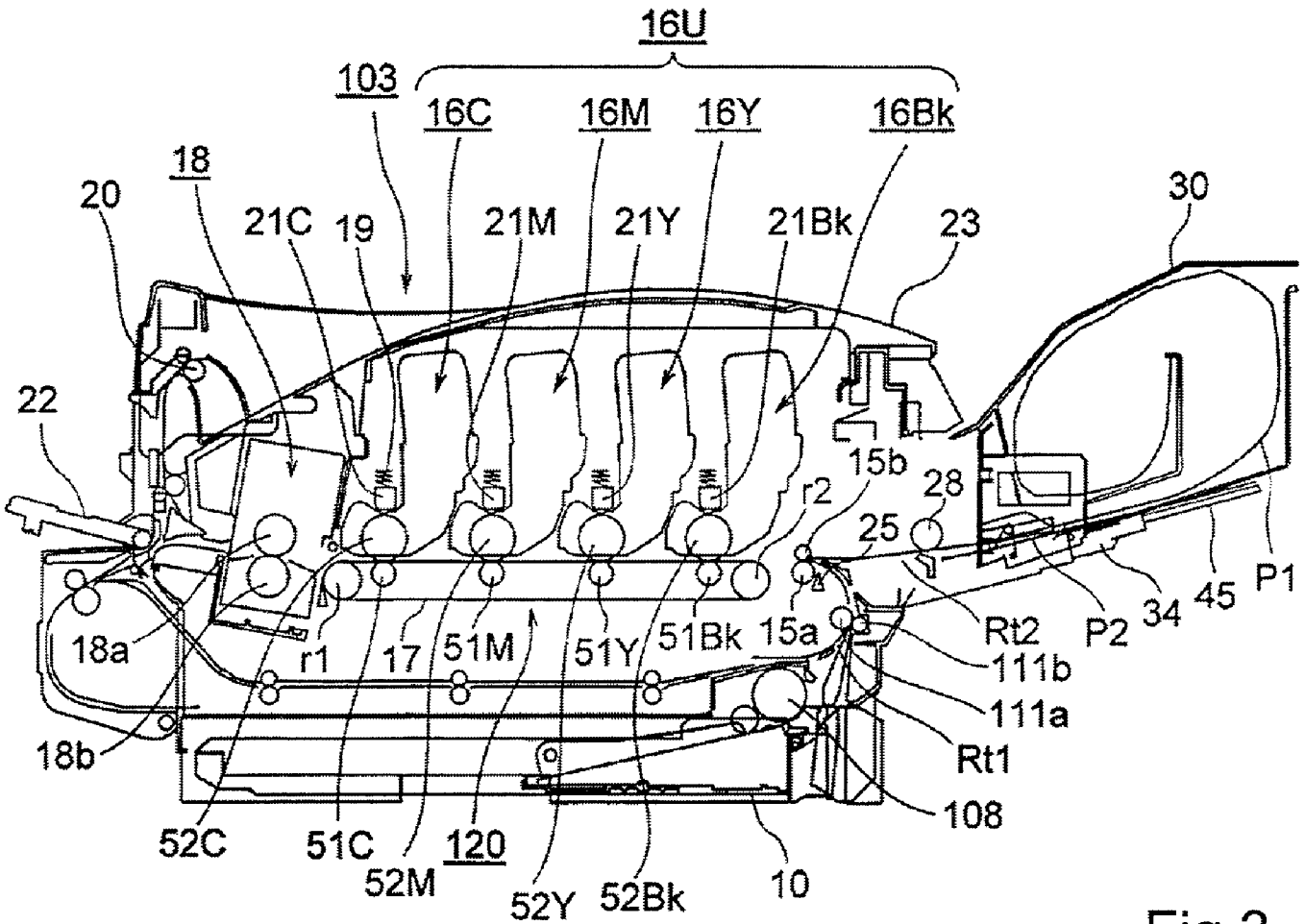
FIG. 3 is a schematic view of a printer according to a first embodiment of the present invention.
Figure 4:
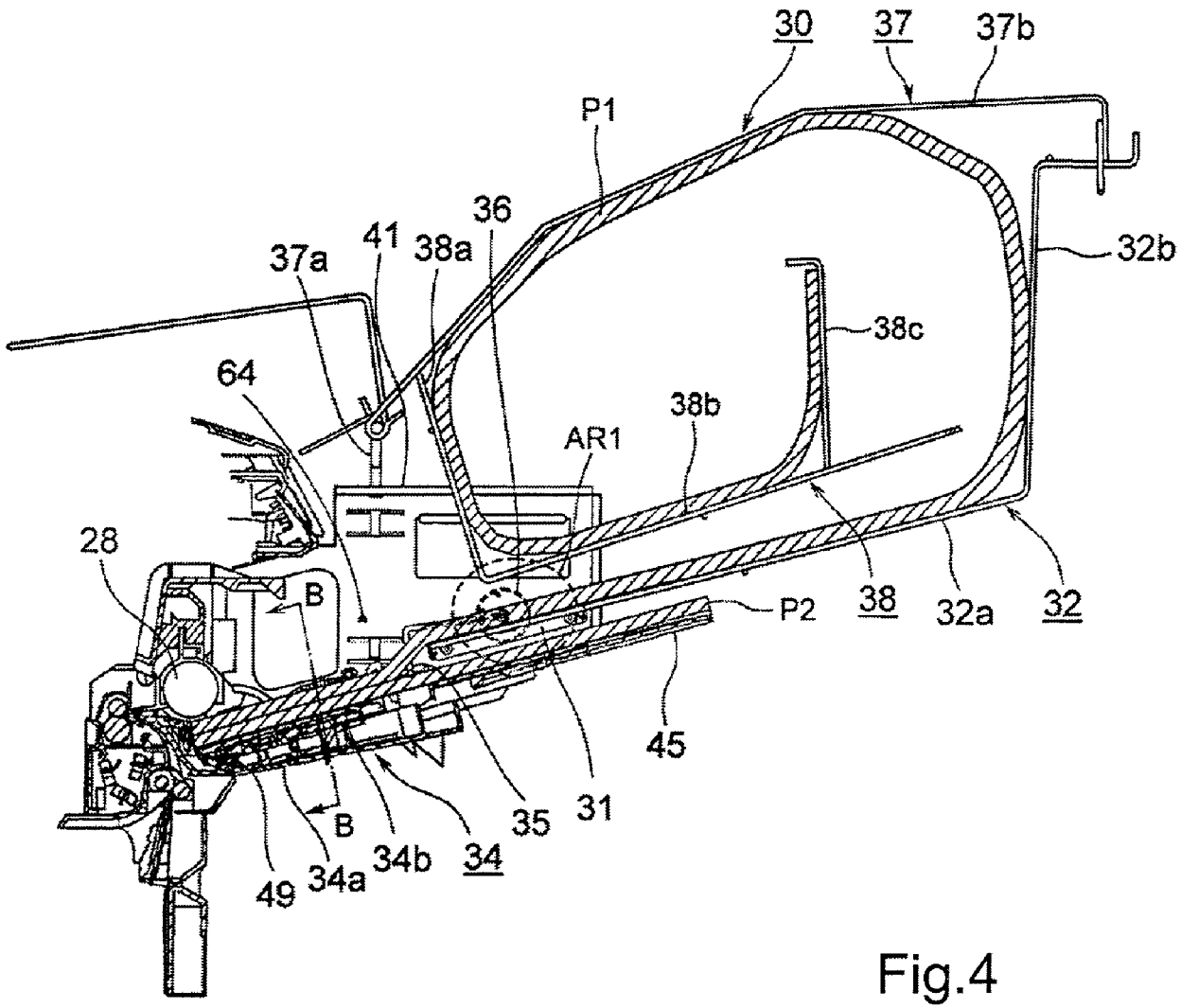
FIG. 4 is sectional view taken along line A-A of FIG. 1.

Referring to FIG. 3, the printer has a sheet cassette 10, a sheet tray 30, an image forming part 16U, a transforming unit 120, LED heads 21Bk, 21Y, 21M, and 21C, and a fuser 18. The sheet cassette 10 functions as a first sheet containing part for containing regular sized sheets, not shown, as a sheet. The sheet tray 30 is detachably connected to a main body 103 of the device and functions as a second sheet containing part for containing a relatively long sheet P1 as a first sheet. The image forming part 16U forms a toner image functioning as a developer image of each color of black, yellow, magenta, and cyan. The transforming unit 120 is located under the image forming part 16U. The LED heads 21Bk, 21Y, 21M, and 21C function as exposing devices. The fuser 18 functions as a fusing device.

A feeding hopper 34 and an extension hopper 45, which are third sheet containing parts, are pivotally connected to and protrude from the main body 103 of the device under the sheet tray 30. The sheet tray 30, the feeding hopper 34 and the extension hopper 45 form a sheet containing device.

The extension hopper 45 is detachably connected to the feeding hopper 34. When the feeding hopper 34 is pivoted and raised while containing the extension hopper 45 in the feeding hopper 34, the feeding hopper 34 may be contained in the main body 103 of the device. A sheet P2 may be placed on the feeding hopper 34 and the extension hopper 45, and at a space is formed between these hoppers and a sheet receiving part 31. The sheet P2 is different from the relatively long sheet P1, and is a second sheet having different size from the relatively long sheet P1 in the present embodiment.

At a front end of the sheet cassette 10A, a hopping roller 108 is located. The hopping roller 108 separates the sheets one by one, and functions as an outputting member, or feeding member, for feeding the sheets to a carrying path Rt1. The sheet output by the hopping roller 108 is carried by a registration roller 111*a* and a pressure roller 111*b*, is further carried by a registration roller 15*a* and a pressure roller 15*b*, and is carried to the image forming part 16U. The registration roller 111*a* and the pressure roller 111*b* are downstream of the hopping roller 108 on the carrying path Rt1 convey sheets. The registration roller 15*a* and the pressure roller 15*b* are downstream of the registration roller 111*a* and the pressure roller 111*b* on the carrying path Rt1. The hopping roller 108, the registration roller 111*a*, and the pressure roller 111*b* form a first sheet feeding part.

A feeding roller 28 is adjacent to the sheet tray 30 and the feeding hopper 34. The feeding roller 28 functions as an outputting member separating the relatively long sheets P1 and the sheets P2 one by one and outputting the sheets to a carrying path Rt2. A sheet sensor 25 is downstream of the feeding roller 28. The sheet sensor 25 functions as a sheet detecting unit detecting a front end (or leading edge) of the relatively long sheet P1.

The image forming part 16U has image forming units 16Bk, 16Y, 16M, and 16C. The LED heads 21Bk, 21Y, 21M, and 21C are respectively attached to an upper cover 23, and are pushed to the image forming units 16Bk, 16Y, 16M, and 16C by springs 19, or bias members.

The image forming units 16Bk, 16Y, 16M, and 16C respectively have such as photoreceptor drums 52Bk, 52Y, 52M, and 52C, a charge roller, a developing roller, a toner supplying roller, a developing blade, a cleaning device, and an image drum motor (ID motor). The photoreceptor drums 52Bk, 52Y, 52M, and 52C function as image supporters. The charge roller, not shown, functions as a charge device for uniformly charging surfaces of each of the photoreceptor drums 52Bk, 52Y, 52M, and 52C. The developing roller, not shown, functions as a developer supporter for forming a toner image, for adhering toner, or developer, in an electrostatic latent image on surfaces of the each photoreceptor drums 52Bk, 52Y, 52M, and 52C, and for developing the images. The toner supplying roller, not shown, functions as a developer supplying member for supplying the developing roller with toner. The developing blade, not shown, functions as a developer regulatory member for forming developer layers having uniform thickness on the developing roller. The cleaning device, not shown, collects toner left on the photoreceptor drum 11 after transferring the toner image. The ID motor, not shown, functions as a driving unit for rotating each of the photoreceptor drums 52Bk, 52Y, 52M, and 52C.

The transferring unit 120 has a drive roller r1, a driven roller r2, a carrying belt 17, transferring rollers 51Bk, 51Y, 51M, and 51C, and a belt motor. The carrying belt 17 functions as a first transferring member and is tensioned by the drive roller r1 and the driven roller r2. The transferring rollers 51Bk, 51Y, 51M, and 51C function as second transferring members and are opposed to the photoreceptor drums 52Bk, 52Y, 52M, and 52C via the carrying belt 17. The belt motor, not shown, rotates the drive roller r1, drives the carrying belt 17, and functions as a driving unit for conveying sheets. In addition, the driven roller r2 tension the carrying belt 17 in this embodiment, however, a tension roller, not shown, may also provide tension.

The fuser 18 has a fusing roller 18*a*, and a pressure application roller 18*b*. The fusing roller 18*a* functions as a first roller and is rotated by a fusing motor, not shown, which functions as a driving unit for fusing. The pressure application roller 18*b* functions as a second roller and rotates together with the fusing roller 18*a*. The heater, not shown, functions as a heating body, and is located within the fusing roller 18*a*.

When the printer having the above-described constitution prints a sheet such as the relatively long sheet P1, the sheet tray 30 is attached to the main body 103 of the device, the relatively long sheet P1 is placed in the sheet tray 30. After that, a print order is ordered to a regulatory part, not shown, of the printer from a host device, not shown, such as a computer. Then a feeding and carrying motor, not shown, is driven. The feeding and carrying motor functions as a driven part for conveying sheets and is located in an upper position of a front end of the sheet tray 30. Accordingly, the feeding roller 28 is rotated, the relatively long sheet P1 in the sheet tray 30 is fed out (to the left in FIG. 3), and the front end of the relatively long sheet P1 abuts against a contacting part of the registration roller 15*a* and the pressure roller 15*b*. At this moment, the feeding and carrying motor is stopped and any skewing of the relatively long sheet P1 is corrected. The feeding roller 28 forms a second sheet feeding part.

Then, the feeding and carrying motors are driven again, the pressure roller 15*b* is rotated in a direction opposite to that of the registration roller 15*a*, and the relatively long sheet P1 is carried to the image forming part 16U. At that time, the pressure roller 15*b* is pushed toward the registration roller 15*a* by a spring so that a carrying force is generated. The spring, not shown, functions as a bias member.

When the belt motor is driven in the image forming part 16U, the carrying belt 17 is travels. The relatively long sheet P1 is carried along with the traveling carrying belt 17. The relatively long sheet P1 passes between each of the roller sets formed by the photoreceptor drums 52Bk, 52Y, 52M, and 52C, and the transferring rollers 51Bk, 51Y, 51M, and 51C. While the relatively long sheet P1 is conveyed past these roller sets, the various colors of toner are is transferred to the sheet and overlap each other in order, and a color toner image is formed.

The relatively long sheet P1 is carried to the fuser 18, a color toner image is fused by the fuser 18, and a color image is formed. An ejecting roller 20 ejects the relatively long sheet P1, and the relatively long sheet P1 is carried and stacked on the upper cover 23. As necessary, the relatively long sheet P1 may be ejected on a sheet tray 22.

Next, the sheet containing device will be described.

As shown in FIG. 1, the sheet tray 30 has a left-side frame 40, which functions as a first side frame, a right-side frame 41, which functions as a second side frame, a sheet receiving part 31, and a tray upper guide 37. The sheet receiving part 31 is attached between bottom parts of the left-side frame 40 and the right-side frame 41. The tray upper guide 37 is located in an upper portion of the sheet tray 31. Left and right supports of the sheet tray 30 are formed by the left-side frame 40 and the right-side frame 41. A lower support is formed by the sheet receiving part 31, and an upper supporter is formed by the tray upper guide 37.

The left-side frame 40 and the right-side frame 41 are main structural frames of the sheet tray 30 and connect with a second sheet feeding part of the main body 103 of the device. Between an attaching face Sa of the main body 103 of the device and the left-side frame 40 and the right-side frame 41, joining parts 201 and 202 are formed. The joining parts 201 and 202 detachably join the sheet tray to the main body 103 of the device. The tray upper guide 37 is supported by a tray upper guide holding parts 42, which are formed on the left-side frame 40 and the right-side frame 41, respectively.

In the sheet receiving part 31, a rotatable guide shaft 64 is located between the left-side frame 40 and the right-side frame 41. The ends of the guide shaft 64 are rotationally supported by the left-side frame 40 and the right-side frame 41 and are prevented from escaping with an E-ring 39, which functions as a fixing member. Close to the guide shaft 64 between the left-side frame 40 and the right-side frame 41, a lift-up shaft 35, or a sheet operating member, is pivotally supported to pivot in directions K and L. One end of the lift-up shaft 35 is joined to the left-side frame 40 by an E-ring 43, which functions as a fixing member. The other end of the lift-up shaft 35 is joined to the right-side frame 41 by another E-ring 43 via a knob 36, which functions as an operating member.

The lift-up shaft 35 has a main body part a1, standing parts a2 (or vertical part), horizontal parts a3, and horizontal parts a4. The main body part a1 extends in a width direction of the relatively long sheet P1. The standing parts a2 extend vertically from both ends of the main body part a1. The horizontal parts a3 extend in a rearward direction from upper ends of the standing parts a2 (to the right in FIG. 5A) from an upper-end of the standing part a2. The horizontal parts a4 extend to sides of the left-side frame 40 and the right-side frame 41 from rear ends of the standing parts a3 and pass through the left-side frame 40 and the right-side frame 41, respectively.

The knob 36 is used for rotating the lift-up shaft 35 and for fixing the lift-up shaft 35 in correct positions by holding and rotating the knob 36 manually. In addition, an evacuating position fixed hole 46 and a feeding position fixed hole 47 are formed in the knob 36 and may freely engage with a projection part 48. The evacuating position fixed hole 46 functions as a first joining part. The feeding position fixed hole 47 functions as a second joining part. The projection part 48 functions as a joining part of the knob 36.

The feeding hopper 34 has a base plate 34*a*, a supporting plate 34*b*, a sheet width guide 33, a hopper spring 49, and a holding device 50. The supporting plate 34*b* is movable upward or downward with respect to the base plate 34*a* and functions as a holding part for holding the sheet (or sheets) P2 and the relatively long sheet (or sheets) P1 stacked on the sheet P2 while overlapped with each other. The sheet width guide 33 is movably supported at ends of the left and right parts of the holding plate 34*b* and aligns each sheet P2 in the width direction. The hopper spring 49 functions as a bias member that biases the holding plate 34*b* in the direction (upward) of arrow M. The holding device 50 holds and fixes the holding plate 34*b* in the lowest position. The holding device 50 has a lock part 62*a*, a lock lever 60, a locked part 62*b*, and a lock lever spring 61. The lock part 62*a* functions as a first engaging element formed under a lower-surface of the holding plate 34*b*. The lock lever 60 is movable in a width direction. The locked part 62*b*, which is formed on the lock lever 60, may freely engage with the lock part 62*a* and functions as a second engaging element. The lock lever spring 61 functions as a bias member biasing the lock lever 60 toward a position in which the lock part 62*a* and the locked part 62*b* are engaged. The friction coefficient between the relatively long sheets P1 is abbreviated as $\mu$1, and the friction coefficient between the sheets P2 is abbreviated as $\mu$2. Although FIG. 5A shows the friction coefficients $\mu$1 and $\mu$2 in association with a single sheet of each type P1, P2, the friction coefficients $\mu$1 and $\mu$2 are understood to refer to the friction between multiple sheets when multiple sheets of each type P1, P2 are stacked, as shown in FIG. 5B.

When an operator feeds a relatively long sheet P1, the lift-up shaft 35 interrupts feeding of a sheet P2. When an operator feeds a sheet P2, the lift-up shaft 35 evacuates the front end of the relatively long sheet P1 from the feeding roller 28.

Therefore, a sheet read-end guide 32 is attached on a front end of the sheet receiving part 31. A relatively long sheet P1 is placed above the sheet receiving part 31, the sheet read-end guide 32, a sheet P2, and the lift-up shaft 35. The relatively long sheet P1 is held such that a rear-end of the relatively long sheet P1 is rolled by a holding guide 38, which holds the rear portion of the sheet, attached to the tray upper guide 37.

Figure 5A:
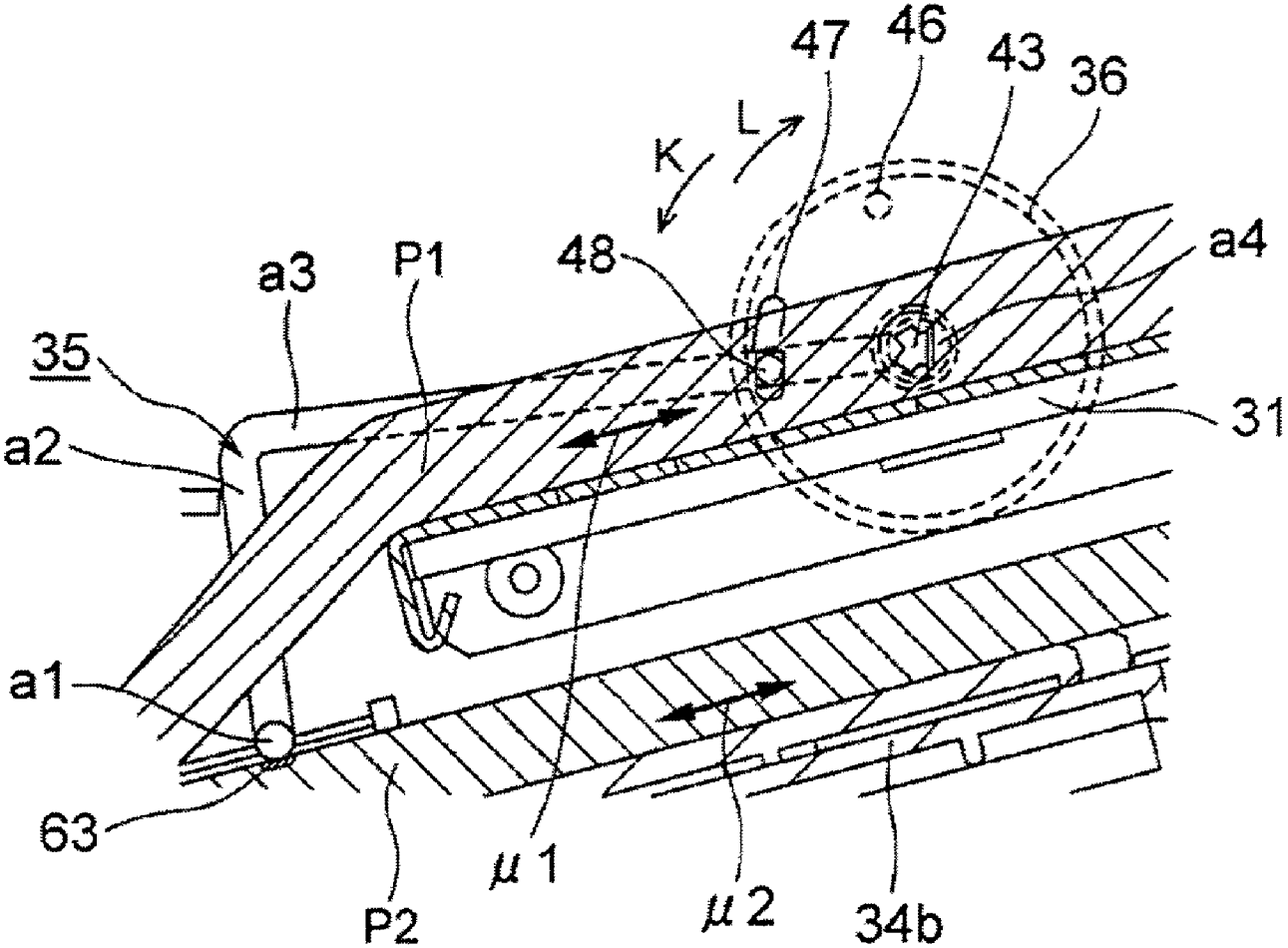
FIG. 5A is an enlarged sectional view of a sheet containing device according to a first embodiment of the present invention.
Figure 5B:
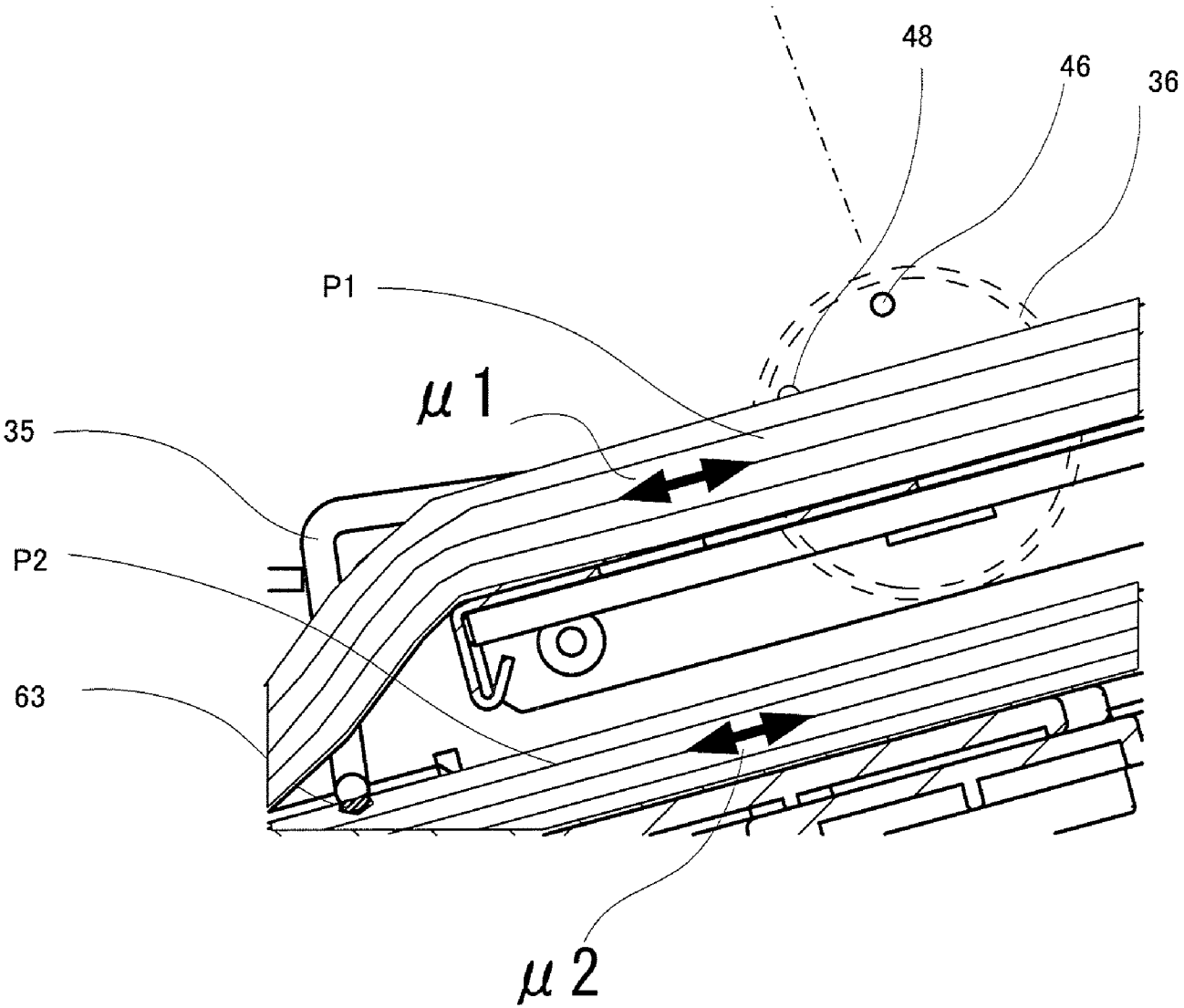
FIG. 5B is another enlarged sectional view of the sheet containing device for illustrating friction co efficiencies μ1, μ2 between sheets. Particularly.
Figure 6:
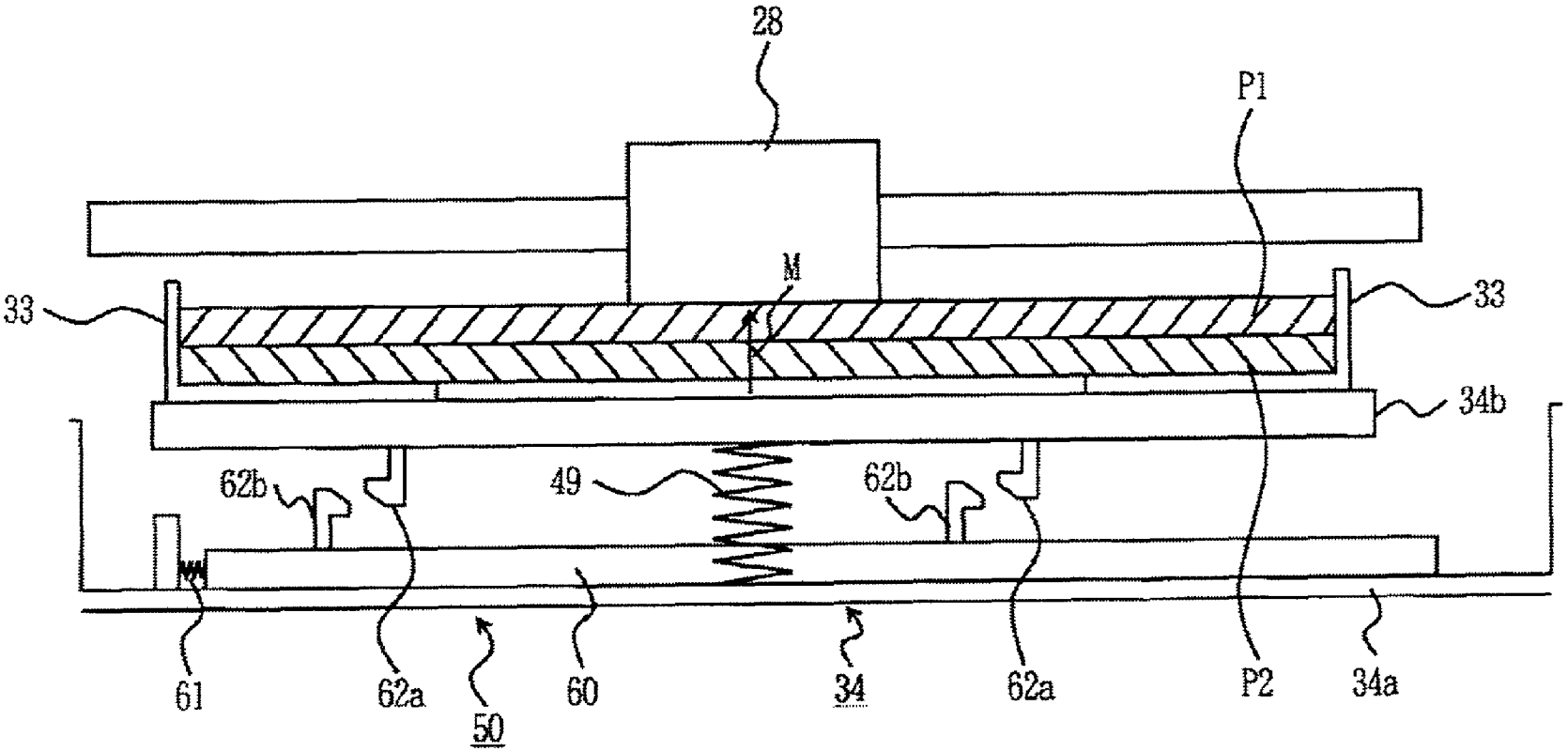
FIG. 6 is a sectional view taken along line B-B of FIG. 4.

As shown in FIG. 5A, a sheet P2 on the holding plate 34*b* is attached under a lower-surface of the main body part a1 of the lift-up shaft 35. The sheet P2 is contacted by a friction material 63, which forms a friction part having large friction coefficient. The friction material 63 is attached to at least a part of a lower-surface of the main body part a1. However, the friction material 63 may be attached to the entire lower-surface of the main body a1 or to multiple parts of the lower-surface of the main body part a1. Treatment of the lower-surface of the main body part a1 may form a friction part having large friction coefficient. When the entire lift-up shaft 35 is formed by material having large friction coefficient, the friction part may be formed.

The sheet read-end guide part 32 has a bottom part 32*a*, extending rearward, and a standing part 32*b*. The standing part 32 is formed by upward bending of a rear-end of the bottom part 32*a*. The tray upper guide 37 has a holding part 37*a*, which is attached to a holding tray upper guide part 42, and a held part 37*b*, which is pivotally connected to the holding part 37*a*. A rear-end of the held part 37*b* and the standing part 32*b* are engaged. A holding guide 38 for holding a rear-portion of the sheet has a dropping part 38*a*, a bottom part 38*b*, and a standing part 38*c*. The dropping part 38*a* drops from a closed portion of a front-end of the tray upper guide 37. The bottom part 38*b* extends in a rearward direction from a bottom-end of the dropping part 38*a*. The standing part 38*c* is formed to extend in an upward direction from a position near a rear-end of the bottom part 38*b*.

Hereafter, movements of the sheet tray 30 will be described.

First, before placing a relatively long sheet P1, a sheet P2 is placed such that a front end of the sheet P2 is near the feeding roller 28 on the feed hopper 34 and the extended hopper 45. The feeding roller 28 is located on a front-end of the supporting plate 34*b*. After placing the sheet P2, an operator rotates the knob 36 in the direction of arrow K (See FIG. 5A), the lift-up shaft 35 is rotated in the direction of arrow K and is set to a feeding position. Engagement of the projection part 48 and the evacuating position fixed hole 46 is released, and the projection part 48 engages with the feeding position fixed hole 47. The feeding position fixed hole 47 has a shape of arc that is designed according to rotating directions of the knob 36, so that the lift-up shaft freely rotates in area of the feeding position fixed hole 47. Accordingly, the friction material 63 on the lift-up shaft 35 contacts a sheet P2, no matter how many sheets P2 are in place.

Next, a relatively long sheet P1 is placed such that a front end of the relatively long sheet P1 contacts the feeding roller 28 on the sheet P2. The operator moves the lock lever 60 to release engagement of the lock part 62*a* and the locked part 62*b*, so that the supporting plate 34*b* is raised in the direction of arrow M by the biasing force of the hopper spring 49, and the relatively long sheet P1 contacts the feeding roller 28. Rotating the feeding roller 28 feeds the relatively long sheet P1.

When there are few relatively long sheets P1 in the sheet tray 30 and the friction coefficient $\mu 2$ is less than $\mu 1$ ($\mu 2 < \mu 1$), the relatively long sheet P1 and the sheet P2 may be piled and may tend to stay together. However, the friction force of the friction material 63 on the lift-up shaft 35 prevents the sheet P2 from being sent with the relatively long sheet P1.

Figure 7:
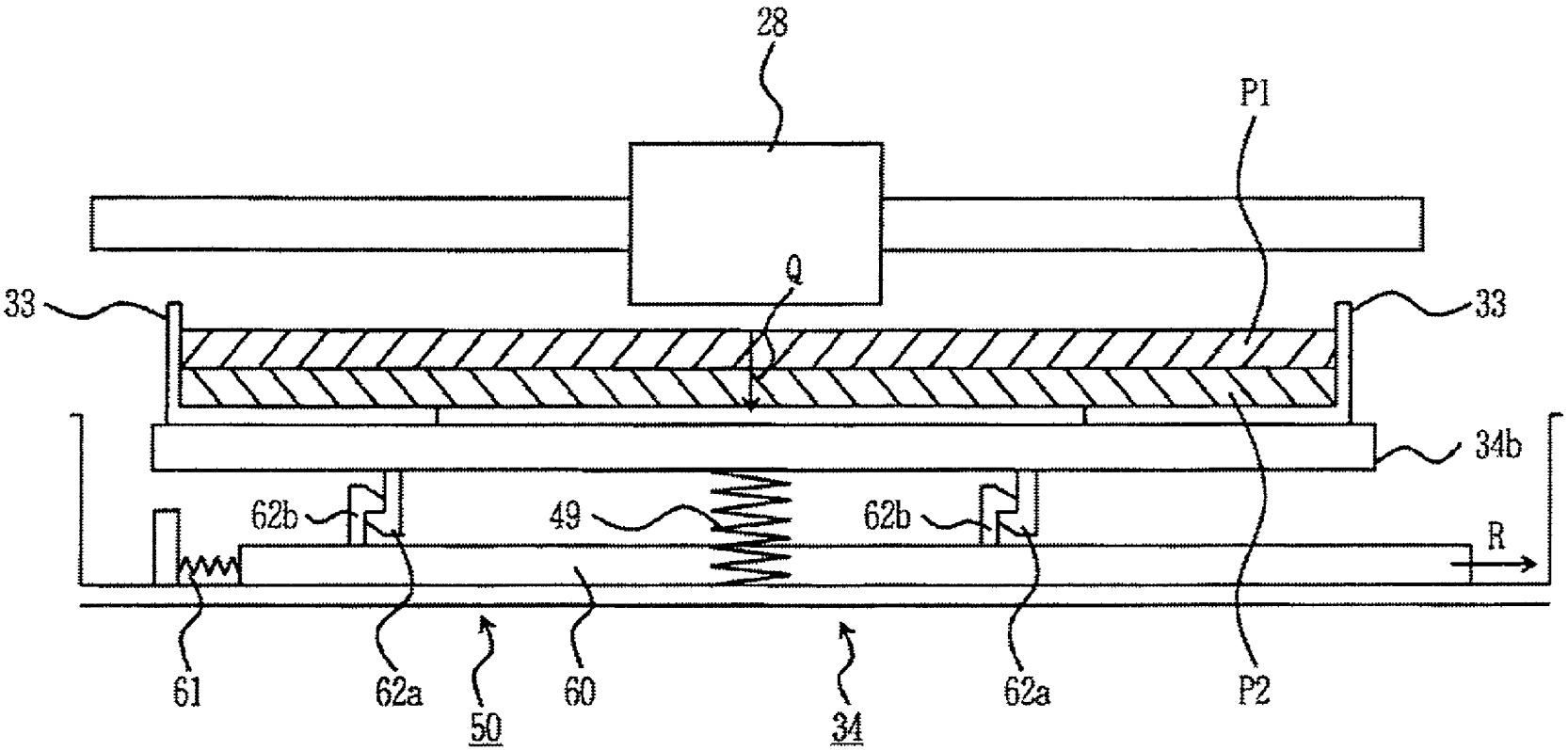
FIG. 7 is a sectional view taken along line B-B of FIG. 4, when the feed hopper is descended.
Figure 8:
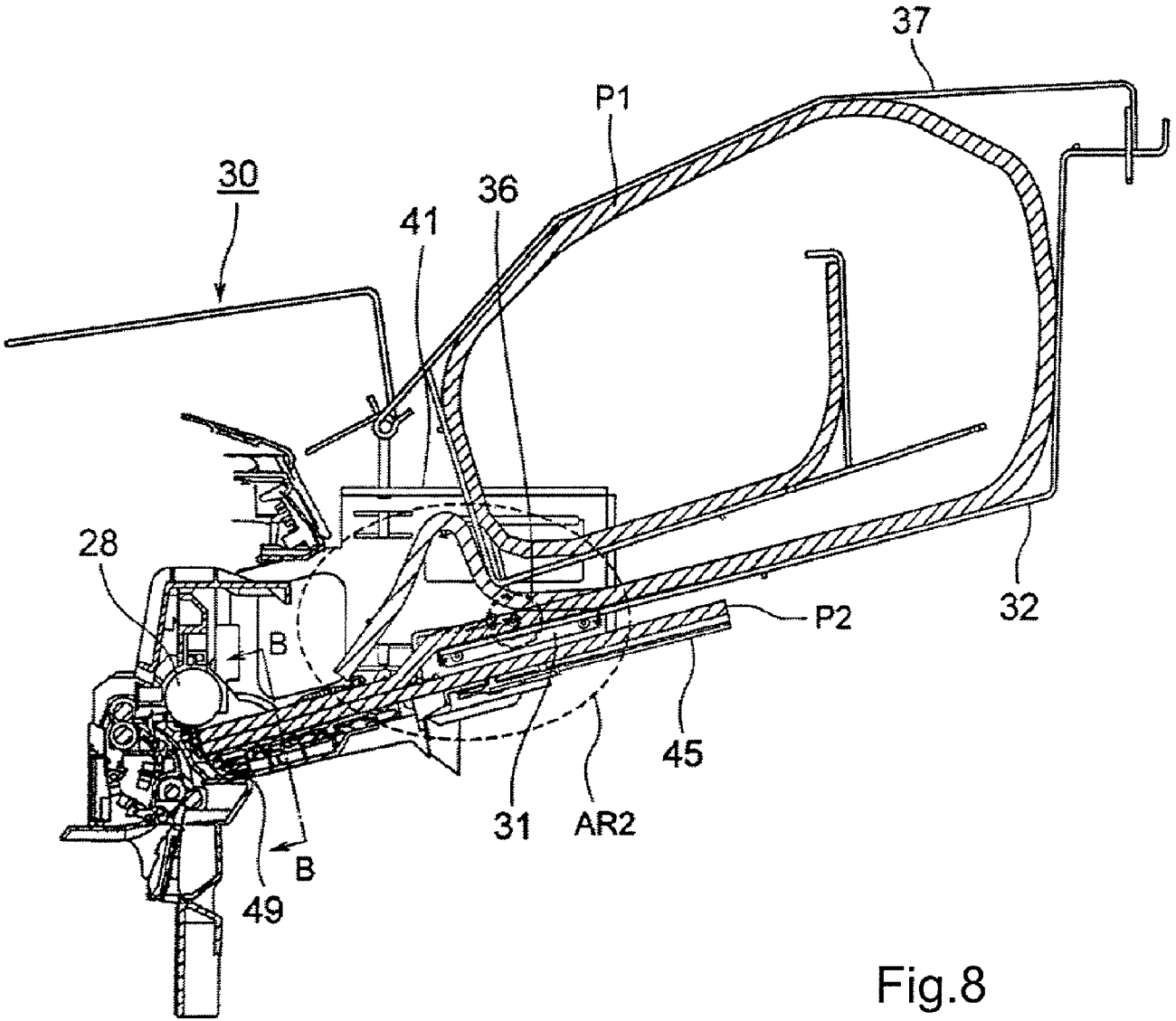
FIG. 8 is a sectional view illustrating movement of a sheet tray according to the first embodiment of the present invention, when the sheet is evacuated.

When feeding of the relatively long sheet P1 is stopped and a sheet P2 is fed, as shown in FIG. 7, and when the supporting plate 34*b* is pressed down in the direction (downward) of arrow Q in order to release the contact between the relatively long sheet P1 and the feeding roller 28, the hopper spring 49 is compressed and the lock part 62*a* engages the locked part 62*b*. The biasing force of the lock lever spring 61 moves the lock lever 60 in the direction of arrow R, maintains engagement of the lock part 62*a* and the locked part 62*b*, and fixes the supporting plate 34 in the lower position.

Figure 9:
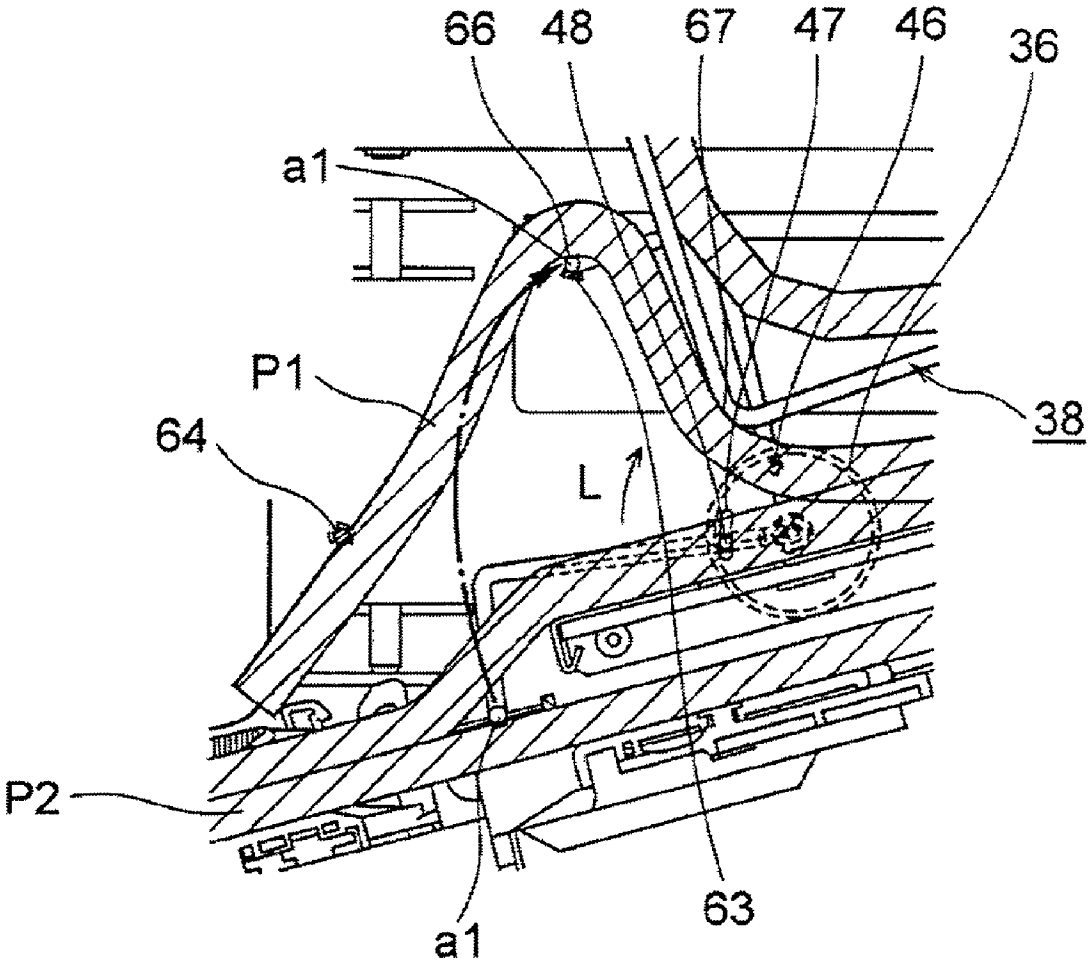
FIG. 9 is an enlarged sectional view of a sheet tray according to the first embodiment of the present invention, when the sheet is evacuated. Particularly.

As shown in FIG. 9, rotating the knob 36 in the direction of arrow L rotates the lift-up shaft 35 in the direction of arrow L, and the lift-up shaft 35 is moved to an evacuating position. Engagement of the projection part 48 and the feeding position fixed hole 47 is released, and the projection part 48 engages the evacuating position fixed hole 46.

The main body part a1 is set in a peak position 66 while contacting a bottom surface of the relatively long sheet P1, uplifts the relatively long sheet P1, and evacuates the relatively long sheet P1 from contact with the sheet P2. Therefore, the front-end of the relatively long sheet P1 moves from the feeding roller 28 and contacts the guide shaft 64. The relatively long sheet P1 is supported at three points, which are the guide shaft 64, the main body part a1, and a corner part 67 of the holding guide 38 for holding rear-portion of the sheet.

Figure 10:
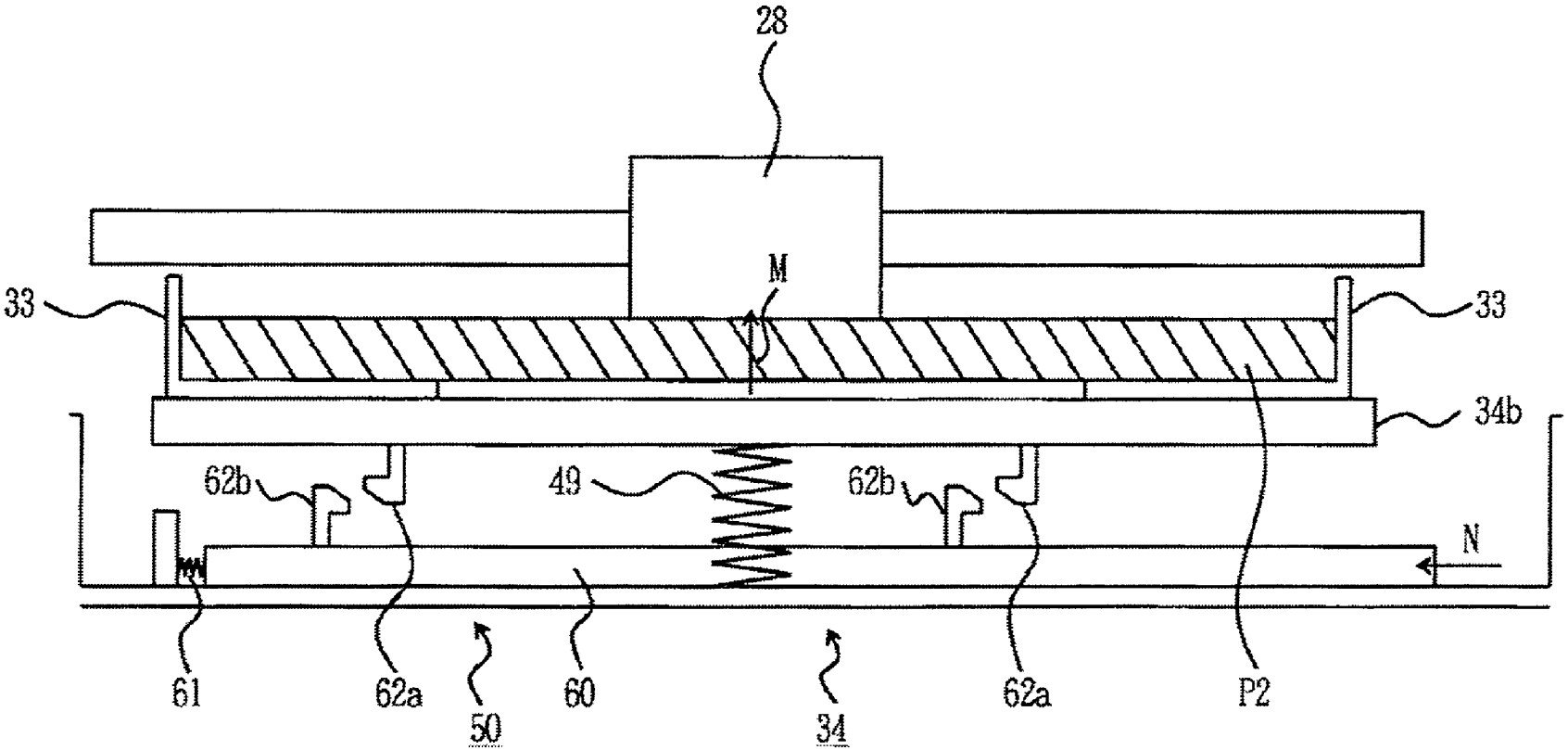
FIG. 10 is a sectional view taken along line B-B of FIG. 4, when a relatively long sheet is evacuated.
Figure 11:
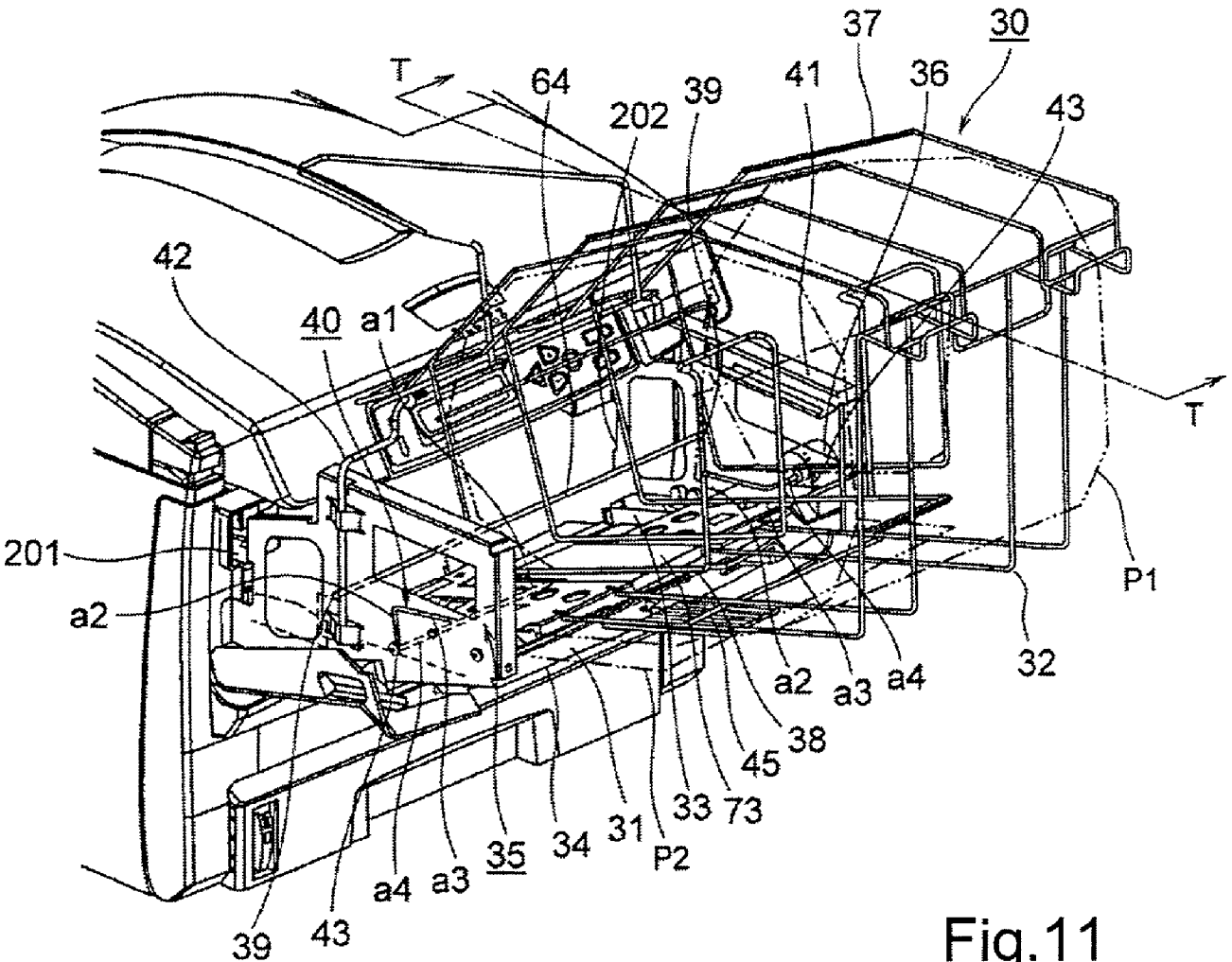
FIG. 11 is a perspective view of a sheet containing device according the second embodiment of the present invention.

As in FIG. 10, the lock lever 60 is operated to move in the direction of the arrow N, to release engagement of the lock part 62*a* and the locked part 62*b*, and the feeding hopper 34 is raised in a direction of arrow M, so that the sheet P2 contacts the feeding roller 28. Accordingly, rotating the feeding roller 28 will feed the sheet P2. When the relatively long sheet P1 is fed again, above-mentioned steps are performed in reverse.

In the present embodiment, rotating the lift-up shaft 35 and placing the lift-up shaft 35 in a feeding position enables the relatively long sheet P1 to be fed, and placing the lift-up shaft 35 in an evacuating position enables the sheet P2 to be fed. Therefore, it is unnecessary for the sheet P2 to be placed in the feeding part of the main body of the device 103 after detaching the sheet tray from the main body 103 of the device and for the sheet P2 to be placed in the sheet tray 30 after feeding the relatively long sheet P1 from the sheet tray 30.

Consequently, not only are the operations of attaching and detaching the sheet tray 30 and replacement of sheets unnecessary, but also spaces for storing the detached sheet tray 30 and the replaced relatively long sheets P1 will be unnecessary.

Hereafter, a second embodiment of the present invention will be described. The same reference numbers are used for elements having a similar structure to corresponding elements of the first embodiment, and effects given by having similar structure of the first embodiment are not repeated.

In the second embodiment, a separation film 73 is fixed on a rear-part of a predefined position of the sheet receiving part 31 of the sheet tray 30. The separation film extends in anterior direction and is located between the relatively long sheet P1 of the first sheet and a sheet P2 of a second sheet. The separation film 73 functions as a sheet-shaped separating member. On a surface of the separation film that contacts with the relatively long sheet P1, various types of coating and matting are formed with materials having a friction coefficient $\mu 3$, which is larger than the friction coefficient $\mu 1$ between the relatively long sheets P1. The sheet tray 30 itself may be formed with material having a friction coefficient $\mu 3$.

The separation film 73 is formed with material having higher rigidity than that of the relatively long sheet P1. The separation film is wider than the feeding roller 28.

Next, movements of the sheet containing device will be described.

Figure 12:
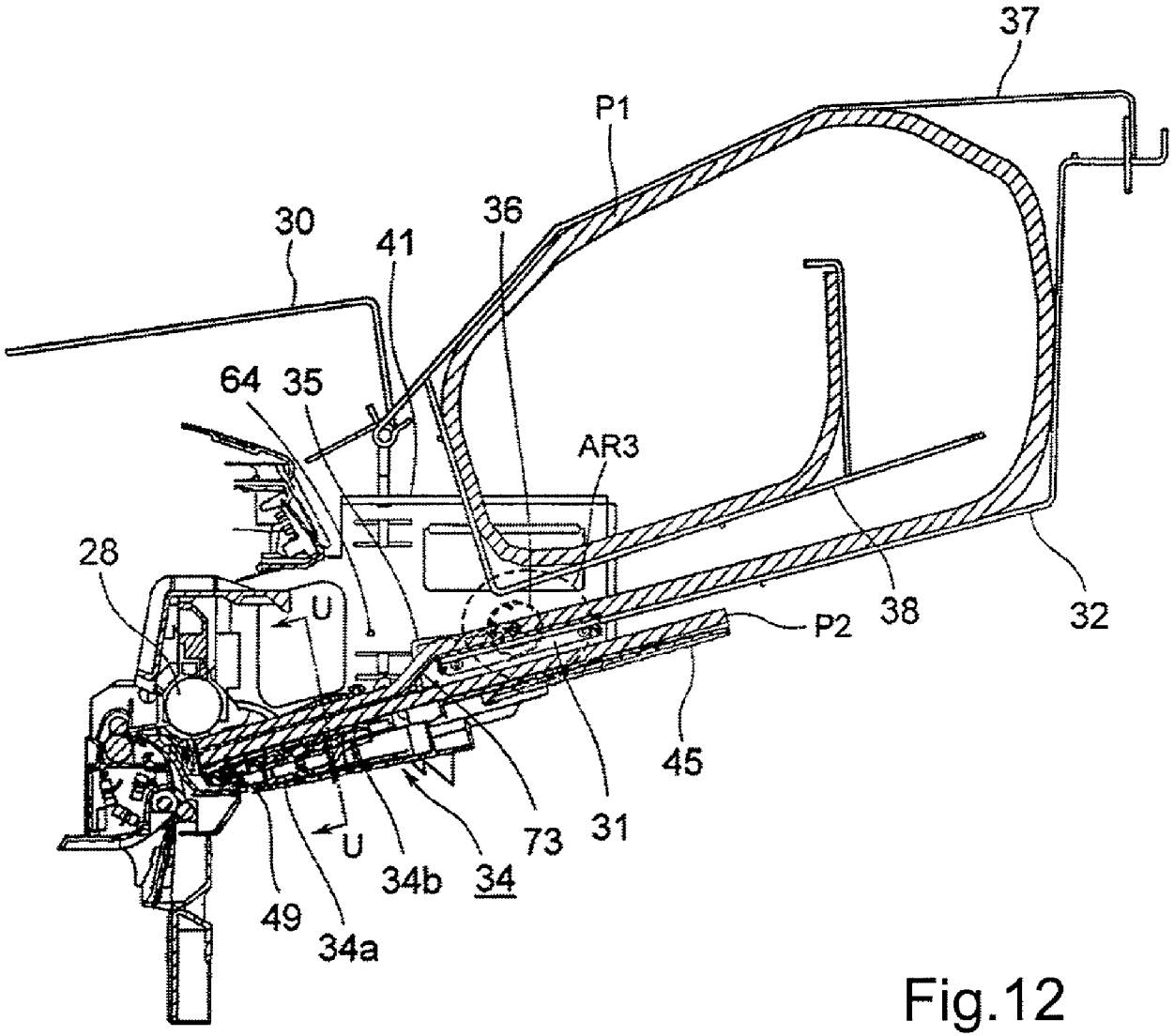
FIG. 12 is a sectional view taken along line T-T of FIG. 11.
Figure 13:
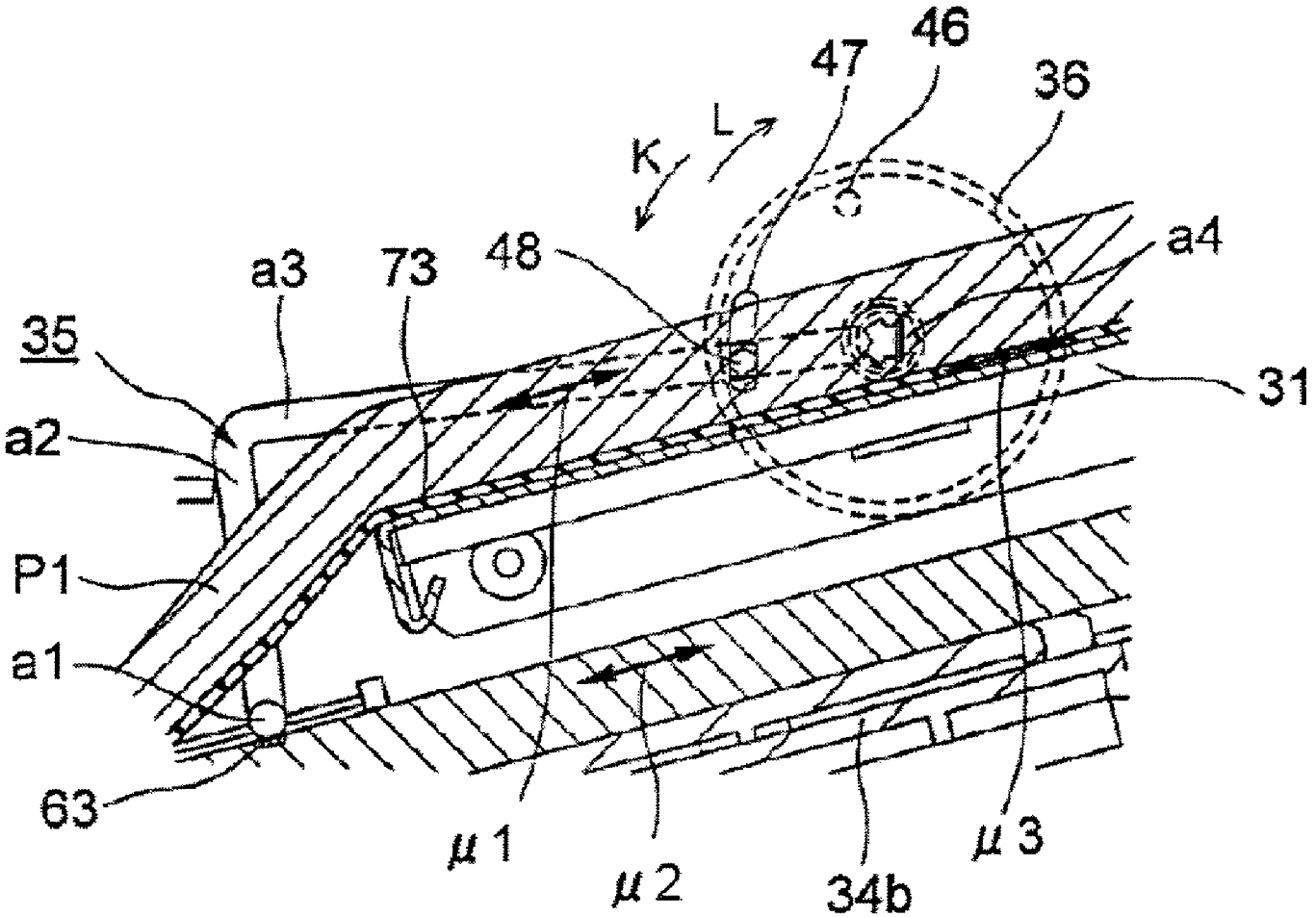
FIG. 13 is an enlarged sectional view of the sheet containing device according to the second embodiment. Particularly.
Figure 14:
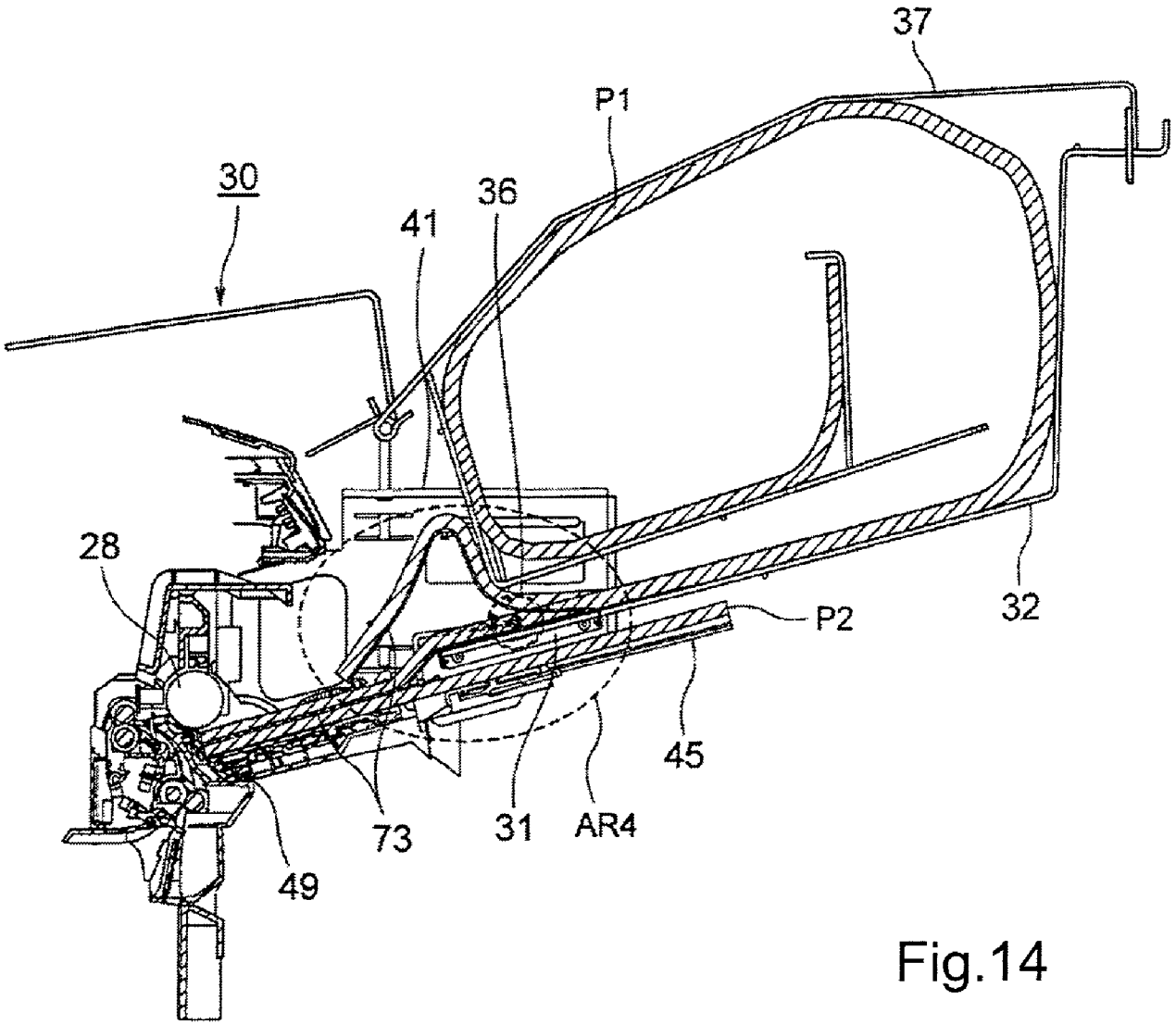
FIG. 14 is a sectional view illustrating movement of a sheet tray according to the second embodiment, when a sheet is evacuated.
Figure 15:
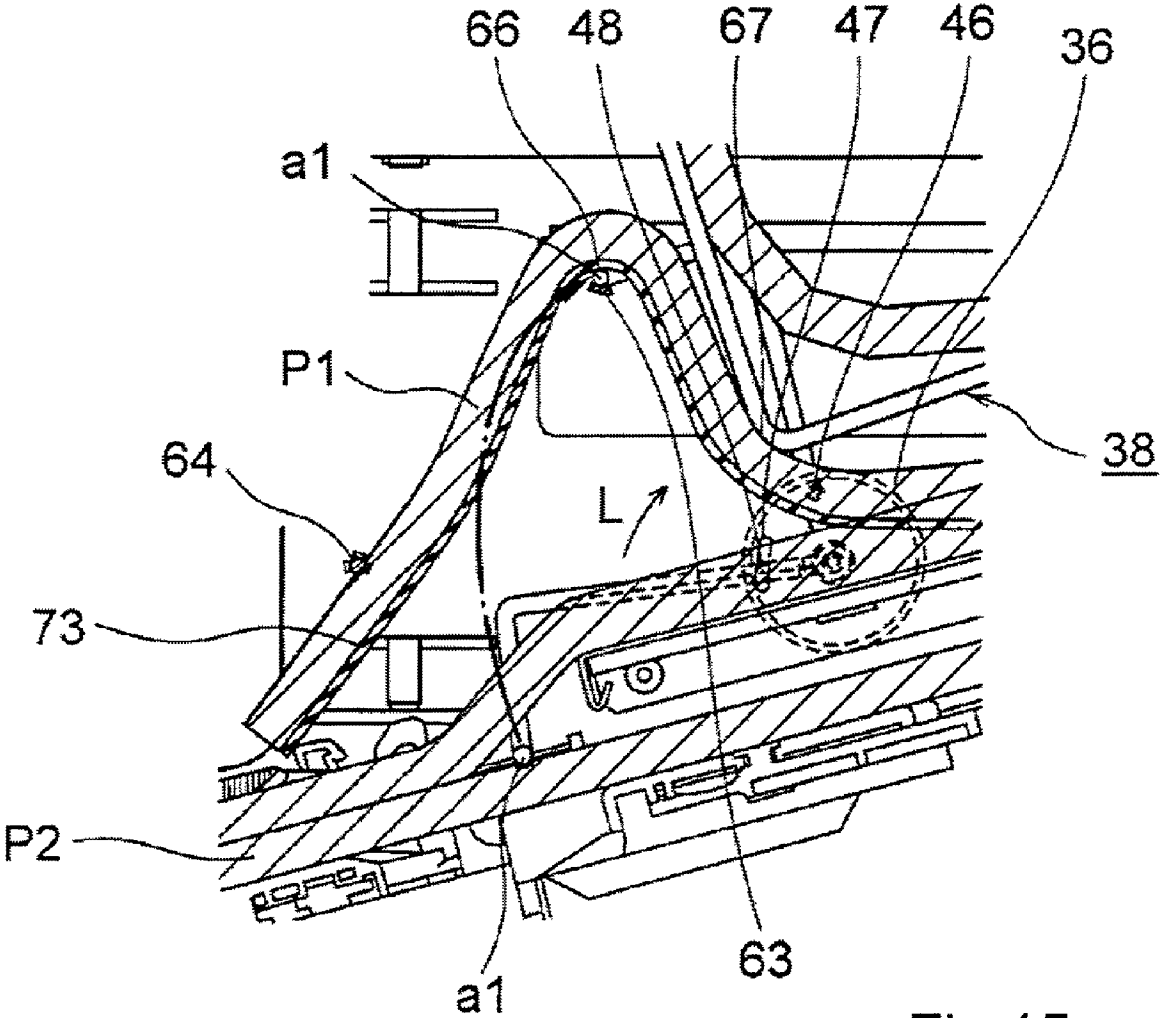
FIG. 15 is an enlarged sectional view of the sheet tray according to the second embodiment, when the sheet is evacuated. Particularly.

First, as shown in FIG. 12 and FIG. 13, placing a relatively long sheet P1 on the sheet P2 keeps the separation film 73 in a position between the relatively long sheet P1 and the sheet 2. Shown in FIG. 14 and FIG. 15, when operator rotates a knob 36 in a direction of arrow L, a lift-up shaft 35 is rotated in a direction of arrow L, and is put at an evacuating position. A main body part a1 of the lift-up shaft 35 uplifts upward both the relatively long sheet P1 and the separating film 73, and the relatively long sheet P1 and the separation film 73 are evacuated from a sheet P2.

Shown in FIG. 13, when an operator rotates the knob 3 in a direction of arrow K, a relatively long sheet P1 and a separation film 73 are descended, and the separation film 73 is placed between the relatively long sheet P1 and a sheet P2.

Figure 16:
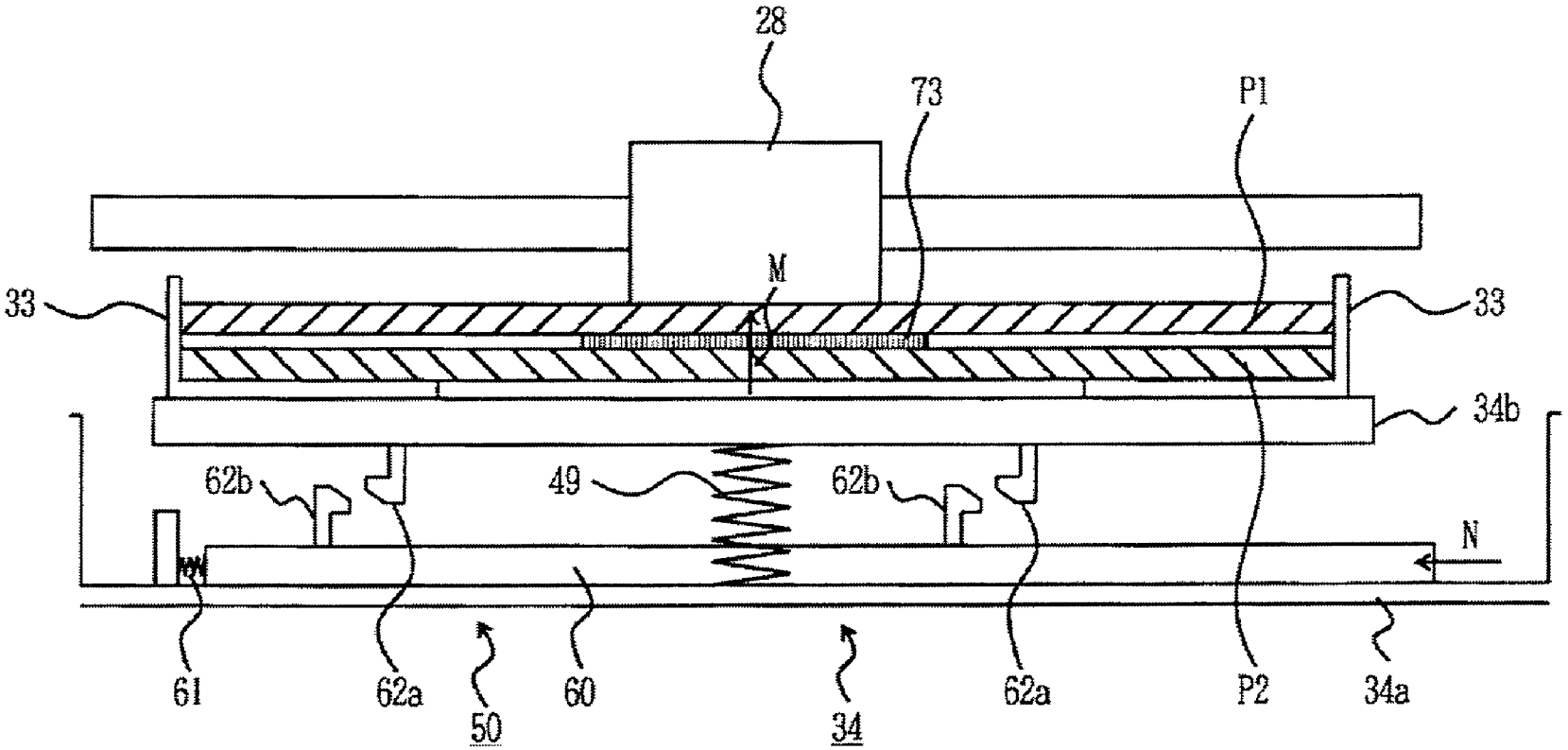
FIG. 16 is a U-U sectional view of FIG. 12, wherein a relatively long sheet is not evacuated, and specifically illustrates that sheets P1 and P2 are both disposed in the vicinity of feeding roller 28.

Shown in FIG. 16, when the supporting plate 34*b* is upwardly uplifted, a relatively long sheet contacts with the feeding roller. Therefore, when the feeding roller 28 is rotated with above-mentioned situation, the relatively long sheet P1 is feed.

When a print order to print more than number of relatively long sheets P1 placed in a sheet tray 30 is requested, the separation film 73 and the feeding roller 28 come into contact after the relatively long sheets P1 placed in the sheet tray 30 are used up. At this time, the printing number of sheets ordered by the print order is not completed, so that the feeding roller 28 continues to rotate for feeding sheets. However, the separation film 73 prevents the feeding roller 28 from contacting the sheet P2, and the separation film is fixed on the sheet receiving part 31. Thus, the feeding roller slips on the separation film, and the sheet P2 is not conveyed.

Therefore, even if certain period of time is passed, the sheet P2 does not reach the sheet detecting sensor 25, the printer indicates a sheet carrying error, and the feeding process is stopped.

As just described, the separation film 73 separates a relatively long sheet P1 from a sheet P2 in the second embodiment. Even if the printer is ordered to print more sheets than the number of relatively long sheets P1 placed in the sheet tray 30, a sheet P2 will not be fed.

Therefore, the sheet P2 is prevented from being printed mistakenly without a special detecting method, which reduces costs.

In each of above embodiments, the knob 36 is rotated by an operator. However, a controller of the printer also may receive a print order ordered by a host device, and the knob 36 may be rotated by a motor of driving unit according to types of sheets used in printing process.

In each of above-mentioned embodiments, the sheet tray 30 is detachably connected to the main body 103 of the device. However, the feeding hopper 34 and the extended hopper 45 may be formed to integrate with the sheet tray 30, so that the whole sheet containing device is detachably connected to the main body 103 of the device.

In the above-mentioned embodiments, a printer as an image forming device is described, however, the present invention may be applied to a photocopier, a facsimile machine, and a multifunction machine, for example.

This disclosure is intended to explain how to fashion and use various embodiments in accordance with the invention rather than to limit the true, intended, and fair scope and spirit thereof. The invention is defined solely by the appended claims, as they may be amended during the pendency of this application for patent, and all equivalents thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

What is claimed is:

1. A sheet containing device comprising:

a supporting part that supports a first sheet and a second sheet, wherein the first sheet and the second sheet are different types of media, and the first sheet and the second sheet are stacked on one another;

a feeding member that is located at a front end of the supporting part and that feeds the first sheet and the second sheet in correspondence with rotation of the feeding member;

a sheet operating member that includes a part positioned between the first sheet and second sheet and that is configured to be movable to either a first position for placing a leading end of the first sheet at the feeding member or to a second position for evacuating the leading end of the first sheet from the feeding member, wherein when the first sheet and the second sheet are stacked on one another, the feeding member feeds only the first sheet when the sheet operating member is in the first position, and the feeding member feeds only the second sheet when the sheet operating member is in the second position.

2. The sheet containing device according to claim 1, wherein the sheet operating member interrupts feeding of the second sheet when the first sheet is fed.

3. The sheet containing device according to claim 2, wherein the sheet operating member has a friction part at the part, the friction part being disposed on the second sheet when the sheet operating member is in the first position.

4. The sheet containing device according to claim 1, wherein the sheet operating member evacuates a front end of the first sheet from a vicinity of the feeding member when the second sheet is fed.

5. The sheet containing device according to claim 1, further comprising a sheet separating member, which is located between the first sheet and the second sheet.

6. The sheet containing device according to claim 1, wherein the supporting part is pivotally supported on the sheet containing device.

7. The sheet containing device according claim 1, wherein the first sheet is different from the second sheet in size.

8. The sheet containing device according claim 1, wherein the sheet operating member is pivotally movable between the first position and the second position, and the sheet operating member is constructed to lift the leading end of the first sheet out of contact with the second sheet and out of a vicinity of the feeding member when the sheet operating member is in the second position.

9. The sheet containing device according claim 1, wherein the sheet operating member is actuated by a knob.

10. An image forming device, comprising:

the sheet containing device according to claim 1, a sheet cassette for containing regular sized sheets, an image forming part that forms a toner image, a transforming unit, and an exposing device.

11. A sheet containing device comprising:

a supporting part that supports a first sheet and a second sheet, wherein the first sheet and the second sheet are different types of media, and the first sheet and the second sheet are stacked on one another;

a feeding member that is located at a front end of the supporting part and that feeds the first sheet and the second sheet in correspondence with rotation of the feeding member;

a sheet operating member that selectively prevents one of the first sheet and the second sheet from being fed by the feeding member when the first sheet and the second sheet are stacked on one another, wherein the sheet operating member is pivotally supported and at least a part of the sheet operating member is located between the first sheet and the second sheet, and a sheet separating film is located between the first sheet and the second sheet, and the sheet operating member is constructed to lift the separating film and to simultaneously lift a leading end of the first sheet out of contact with the second sheet and out of a vicinity of the feeding member when the sheet operating member is pivoted to a position in which the sheet operating member prevents feeding of the first sheet.

12. A sheet containing device comprising:

a supporting part that supports a first sheet and a second sheet, wherein the first sheet and the second sheet are different types of media, and the first sheet and the second sheet are stacked on one another;

a feeding member that is located at a front end of the supporting part and that feeds the first sheet and the second sheet in correspondence with rotation of the feeding member;

a sheet operating member that selectively prevents one of the first sheet and the second sheet from being fed by the feeding member, wherein the supporting part is movable in a vertical direction, and the sheet containing device includes a locking mechanism for locking the supporting part in a lower position, wherein the supporting part is biased to an upper position by a spring when the locking mechanism is released.

13. A sheet containing device comprising:

a supporting part that supports a first sheet and a second sheet, wherein the first sheet and the second sheet are different types of media, and the first sheet and the second sheet are stacked on one another;

a feeding member that is located at a front end of the supporting part and that feeds the first sheet and the second sheet in correspondence with rotation of the feeding member;

a sheet operating member that selectively prevents one of the first sheet and the second sheet from being fed by the feeding member, wherein the sheet operating member is actuated by a knob, and the knob has a first opening, which is engaged by a projection part when the sheet operating member is in a position to prevent feeding of the first sheet, and the knob has a second opening, which is engaged by the projection part when the operating member is in a position to permit feeding of the first sheet.

14. A method of operating a sheet feeding device comprising:

supporting a first sheet and a second sheet, which are different in length, such that at least leading ends of the first sheet and the second sheet are in a parallel, stacked relationship, and the first sheet is located above the second sheet;

feeding one of the first sheet and the second sheet with a feeding member, which is located at the leading ends of the first sheet and the second sheet;

lifting the leading end of the first sheet from a vicinity of the feeding member with a sheet operating member to prevent the first sheet from being fed by the feeding member; and moving the sheet operating member into contact with an upper surface the second sheet to prevent the second sheet from being fed by the feeding member.

15. A method of operating a sheet feeding device according to claim 14, wherein the method further includes actuating the sheet operating member manually with a knob.

16. A method of operating a sheet feeding device according to claim 14, wherein the method further includes supporting the first sheet above the second sheet such that a space is provided between an upper surface of the second sheet and a lower surface of the first sheet at a trailing end of the sheets.

17. A method of operating a sheet feeding device according to claim 14, wherein the method further includes providing a separating film between the first sheet and the second sheet.

* * * * *